United States Patent [19]

Baziuk

[11] Patent Number: 4,742,339

[45] Date of Patent: May 3, 1988

[54] CUTLERY DETECTOR AND ALARM

[76] Inventor: Nelson Baziuk, 7860 Tweedsmuir Ave., Richmond, B.C., Canada, V7A 1L4

[21] Appl. No.: 905,875

[22] Filed: Sep. 10, 1986

[51] Int. Cl.[4] ..... G08B 21/00

[52] U.S. Cl. ..... 340/568; 324/228; 336/65; 336/84 M; 340/540; 340/674

[58] Field of Search ..... 340/568, 540, 674; 346/17, 25, 146; 324/228, 239; 336/65, 84 M

[56] References Cited

U.S. PATENT DOCUMENTS 4,367,138 1/1983 Kustas ..... 209/224

4,494,657 1/1985 Oldenkamp ..... 209/636

4,563,644 1/1986 Lenander et al. ..... 324/239

*Primary Examiner*—Glen R. Swann, III

*Attorney, Agent, or Firm*—Kelly, Bauersfeld & Lowry

[57] ABSTRACT

A cutlery detector device is provided for detecting metal objects discarded as trash along with non-metallic trash material. The detector device includes a metal detecting ring or the like mounted at the top of a trash receptacle, in combination with circuitry adapted to trigger an alarm upon passage of a metal object such as a cutlery item into the trash receptacle. A counter may also be provided to count the number of metal objects placed into the trash receptacle.

15 Claims, 1 Drawing Sheet

CUTLERY DETECTOR AND ALARM

FIELD OF THE INVENTION

This invention is directed to an apparatus which is useful for detecting metal objects which are passed into refuse containers, keeping count of the number of metal objects passed into the container and providing an alarm signal when the metal objects pass into the refuse container.

BACKGROUND OF THE INVENTION

There is a continuing problem in the restaurant business to minimize the loss of cutlery and other valuable metal objects into refuse containers. The problem is particularly severe when the owner or manager of the restaurant is absent, or the restaurant is very busy. Either deliberately or inadvertently, leftover food on a plate together with one or more items of cutlery are simply scraped by lazy or careless busboys into the refuse container. Thus expensive cutlery is lost to refuse disposal on a steady basis and must be replaced.

The applicant is aware of the following references which disclose devices which are more or less relevant to this area of the art:

| U.S. Pat. No. | Issue Date | Inventor |
|---|---|---|
| 4,367,138 | January 4, 1983 | Kustas |
| 4,494,657 | January 22, 1985 | Oldenkamp |

Kustas discloses a cylindrically shaped scraper which is mounted on a steel dish cleaning table which in turn is mounted over a refuse container. The interior of the scraper includes a plurality of magnets. The magnets attract and hold stainless steel flatware when food and wastepaper, together with the flatware, are passed through the interior of the scraper.

Oldenkamp discloses a housing member for removing magnetic articles from a flow of loosely packed material containing a mixture of magnetic articles and non-magnetic articles. The housing member mounts on the top of a rubbish receptacle and is used for separating metal objects such as tableware from rubbish which consists of food and paper waste.

Other references which may be of interest are cited on the cover sheets of the Kustas and Oldenkamp patents, and in the Background portion of each of those two patents.

SUMMARY OF THE INVENTION

An apparatus is provided for detecting metal objects which are disposed into refuse containers. The apparatus comprises a metal detector, and a detection ring positioned around the circumference of the refuse container. The ring is constructed to detect any metal objects such as cutlery which pass through the ring and into the refuse container. The sensitivity of the detector can be set so that it is sensitive only to large metal objects such as cutlery and is not activated when small metal items such as aluminum foil pass through the ring. When a large metal object passes through the ring, a buzzer and/or light may be activated. Also, the device may include a counter which counts the number of metal objects which pass through the ring.

The invention is directed to a detector for detecting metal objects which may be discarded as waste comprising: (a) an electrically operated metal detecting means; (b) electronic circuitry connected to the metal detecting means; and (c) an electric alarm means which is activated when the metal detecting means senses the presence of a metal.

The metal detecting means may be a ring which may be mounted above a trash receiving means. The metal detecting ring may be connected to an electric alarm system which, when metal is detected by the ring, is activated to generate a loud audible sound or light a light bulb or light emitting device.

The trash receiving means may be mounted on a platform which includes a retaining means for holding the base of the trash receiving means on the platform. The detector may include a counting means which is activated whenever the metal detector means senses the presence of a metal. The detecting means may be specifically adapted to detect the presence of metal flatware. A circular shielding band may be affixed to the exterior perimeter of the ring to prevent the ring from detecting metal objects carried by persons passing the metal detecting ring.

A flexible skirt may be attached to the circumference of the ring and suspended from the ring to envelop the circumference of the top of the trash receiving means or an adjustable ring may be attached to the lower circumference of the skirt and fit around the circumference of the top of the trash receiving means. The ring may be tightened around the circumference of the top of the trash receiving means.

The method of detecting valuable metal objects which may be discarded along with trash may comprise utilizing a metal detecting device in a position proximate to the opening of a trash container to sense the presence of any metal object which may pass into the opening of the trash container and sounding an alarm when a metal object is detected. The number of metal objects detected may be counted.

DRAWINGS

DETAILED DESCRIPTION OF ONE EMBODIMENT OF THE INVENTION

Figure 1:
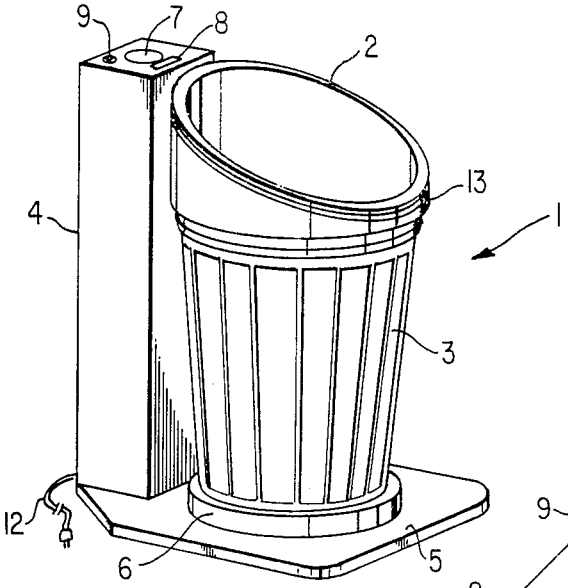
FIG. 1 represents a perspective view of the metal detecting device consisting of a metal detector ring, mounted over a standard trash bin, coupled with an alarm system and a counter.

Referring to FIG. 1 of the drawings, FIG. 1 depicts a specific embodiment of the cutlery detector 1 in perspective view. The cutlery detector 1 is constructed to include a metal detector ring 2 which is positioned above a standard refuse, trash or garbage bin 3. While optional, the metal detecting ring 2 shown in FIG. 1 is slanted so that when it faces in a desired direction, it presents a larger area opening to anyone standing on that side of the bin and wishing to dispose garbage or trash into the bin. The trash bin 3 is positioned directly below and within the area circumscribed by the metal detecting ring 2.

The metal detecting ring 2 is connected to an alarm, light and counter housing 4. The alarm housing 4 comprises a vertical post which is positioned adjacent the metal detecting ring 2 and the trash bin 3. The metal detecting ring 2 is connected both physically and electrically to the upper portion of the housing 4. The alarm housing 4 at its base rests upon a bin platform 5 which extends under the base of the trash bin 3. A bin bottom retaining ring 6 is mounted on the bin platform 5 and is of a circumference suitable for receiving the bases of most standard bin platforms.

Figure 2:
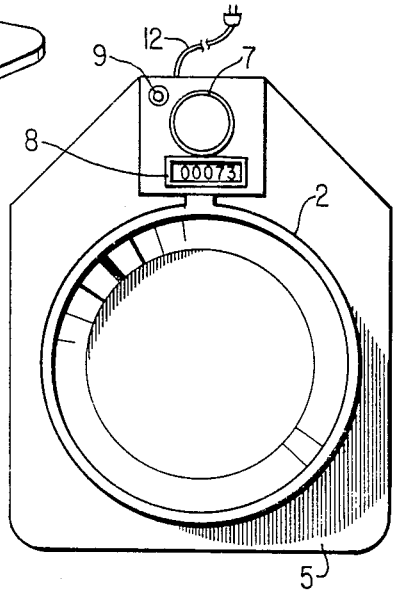
FIG. 2 represents a top view of the metal detecting device.

FIG. 2 illustrates a top view of the cutlery detector 1. A loudspeaker 7 for the alarm system, a counter 8 and an alarm light 9 are shown positioned on the top surface of the housing 4. The ring 2 extends out over the platform 5. An electrical cord 12 for supplying electricity to the metal detecting ring 2 and the alarm system is connected to the detector 1.

Figure 3:
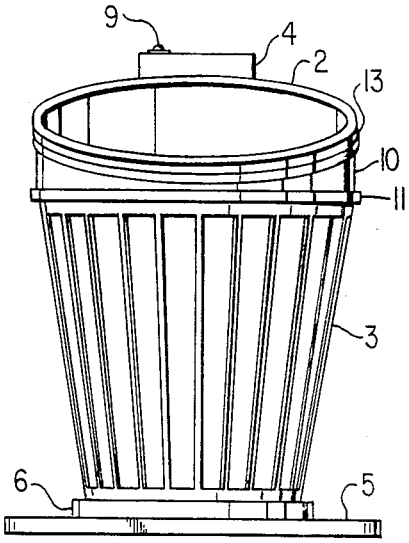
FIG. 3 represents a front view of the metal detecting device.

FIG. 3, which depicts a front view of the detector 1, demonstrates the manner in which the trash bin 3 fits under the detecting ring 2. The base of the bin 3 fits within bin bottom retaining ring 6. The top circumference of the bin 3 fits within a flexible, water and trash impervious skirt 10 which is suspended from ring 2. An adjustable retaining ring 11 is connected to the lower circumference of the skirt 10 and clamps around the top circumference of the bin 3. The flexible skirt 10 and adjustable retaining ring permit the detector 1 to accommodate various heights and widths of bins 3 and ensure that trash passed through the interior of the ring 2 will travel into the interior of the bin 3. The skirt 10 can typically be constructed of dark polyethylene film, such as is used to construct standard garbage bags. The skirt 10, if constructed of a non-metallic material, can cover the ring 2 (since it will not interfere with its metal detecting capability) and thereby keep the ring 2 clean. The skirt 10 can be replaced from time to time with a clean skirt 10.

A circular metal band 13 may be located and affixed to the exterior perimeter of the ring 2 to prevent the ring 2 from detecting metal objects such as pots, pans, keys, coinage, and the like, which might be carried by persons passing proximate to the exterior of the ring 2.

Standard solid state electronic circuits which are associated with standard metal detectors are located within the alarm housing 4 and are powered through electric cord 12. The electronic circuitry is designed so that when a metal object of reasonable predetermined size passes or breaks through the interior plane circumscribed by the metal detecting ring 2, the presence of the metal is detected by the circuitry. In turn, the circuitry is connected to a general mechanical, electronic or electrical sound alarm system which is connected to loudspeaker 7 and light 9. The alarm can be a standard electrical buzzing sound, a mechanical sound, or a modern electronic warning sound. The sound alarm system is activated when a metal object of reasonable size passes through the interior plane circumscribed by the metal detecting ring 2. The sensitivity of the mechanism can be set so that small insignificant metallic items such as foil, are not detected. Thus, for example, if food scraps from a plate, such as those used by restaurants, are scraped into the trash bin 3 through metal detecting ring 2, and a sizeable metal object such as a knife, fork or spoon is present among the food scraps, the ring 2 detects the presence of the metal, which in turn activates the alarm system. When the alarm sounds, everyone within hearing range is alerted to the fact that a metal object, typically a knife, fork or spoon, has been disposed in the trash bin 3.

The counter 8 in the alarm housing 4 can be an optional feature of the cutlery detector 1. The purpose of such a counter 8 is to count the number of metal objects which pass through the interior of the metal detecting ring 2 within a given time. The advantage of the counter 8 is that the incidence of metal objects such as knives, forks and spoons passing through the metal detecting ring 2 can be determined even if the person monitoring the situation, for instance, the restaurant manager, is not present whenever the alarm sounds. This is advantageous in situations where, for example, the restaurant is open on a 24 hour basis and the manager cannot be present over the entire 24 hour period. The counter is protected so that it cannot be reset to zero or some other number without the use of a key which is retained by the manager and permits access to the interior of the housing 4.

The advantage of using a metal detecting ring 2 in place of a permanent magnet, such as those disclosed in the prior art, is that non-magnetic metals will be detected in addition to magnetic metals. A further advantage of the metal detecting ring 2 is that in order to function, it is not necessary that it physically attract the metal object. The metal detecting ring 2 need only simply detect the existence of the metal object of reasonable size as it passes through the plane circumscribed by the metal detecting ring 2. Since the metal detecting ring 2 has no magnetic properties, it does not tend to collect or become clogged over time with metal objects and other trash, as is the case with devices disclosed by Kustas, Oldenkamp, and others.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A detector for detecting metal objects in non-metallic material which may be discarded as waste along a predetermined path, comprising:

(a) an electrically operated metal detecting means mounted proximate to the path travelled by the non-metallic material, and including means for shielding said metal detecting means so that it is not sensitive to metal objects located to the exterior of the path travelled by the non-metallic material;

(b) electronic circuitry means connected to the metal detecting means, said circuitry means being activated when a metal object passes along the path proximate to said metal detecting means; and (c) alarm means which is activated by said circuitry means upon activation of said circuitry means to provide an alarm signalling the passage of a metal object along the path.

2. A detector as defined in claim 1 wherein the metal detecting means comprises a curved member surrounding at least a substantial portion of the path travelled by the non-metallic material, and including means for passing an electrical current through said member, whereby the electrical current is altered and said alteration is detected by said circuitry means upon passage of a metal object along the path.

3. A detector as defined in claim 2 wherein the metal detecting means is mounted above a trash receiving means.

4. A detector as defined in claim 3 wherein the alarm means comprises an electric alarm system which, when a metal object is detected by the metal detecting means, is activated to generate a loud audible sound.

5. A detector as defined in claim 3 wherein the alarm means comprises a light to generate a visual signal when the metal detecting means detects the existence of a metal object.

6. A detector as defined in claim 3 wherein the trash receiving means is mounted on a platform which includes a retaining means for holding the base of the trash receiving means on the platform.

7. A detector as defined in claim 1, 2 or 3 wherein the detector includes a counting means which is activated whenever the metal detecting means senses the presence of a metal object.

8. A detector as defined in claim 4 or 5 wherein the detector includes a counting means which is activated whenever the metal detector means senses the presence of a metal.

9. A detector as defined in claim 3 wherein a flexible skirt is attached to the curved member and is suspended from the curved member to substantially envelop the circumference of the top of the trash receiving means.

10. A detector as defined in claim 9 wherein an adjustable ring is attached to the lower circumference of the skirt and can be adjusted to fit around the circumference of the top of the trash receiving means.

11. A detector as defined in claim 10 wherein the ring can be tightened around the circumference of the top of the trash receiving means.

12. A detector as defined in claim 2 wherein said curved member comprises a ring.

13. A method of detecting valuable metal objects which may be discarded along with trash into a trash container, comprising the steps of: utilizing a metal detecting device in a position proximate to the opening of the trash container to sense the presence of any metal object which may pass along with the trash into the opening of the trash container, shielding the metal detecting device to prevent sensing the presence of any metal object which may pass along a path exterior to the opening of the trash container, and activating an alarm when a metal object is detected by the metal detecting device.

14. A method as defined in claim 13 wherein the number of metal objects detected is counted.

15. A detector for detecting metal objects in non-metallic material which may be discarded as waste along a predetermined path, comprising:

(a) an electrically operated metal detecting means mounted proximate to the path travelled by the non-metallic material;

(b) electronic circuitry means connected to the metal detecting means, said circuitry means being activated when a metal object passes along the path proximate to said metal detecting means;

(c) alarm means which is activated by said circuitry means upon activation of said circuitry means to provide an alarm signalling the passage of a metal object along the path; and (d) counting means activated by the passage of a metal object along the path proximate to said metal detecting means for counting the number of metal objects passing along said path.

* * * * *